United States Patent [19]

Grigoriev

[11] Patent Number: 4,538,308

[45] Date of Patent: Sep. 3, 1985

[54] CONVERTIBLE FURNITURE

[76] Inventor: Nikita Grigoriev, P.O. Box 107, Jordanville, N.Y. 13361

[21] Appl. No.: 559,987

[22] Filed: Dec. 9, 1983

[51] Int. Cl.[3] ..... A47C 17/13

[52] U.S. Cl. ..... 5/37 C; 5/58; 297/105

[58] Field of Search ..... 5/12, 37 C, 37 R, 37 B, 5/47, 48, 17, 18 R, 58, 43, 44 R, 44 B; 297/105, 112

[56] References Cited

U.S. PATENT DOCUMENTS 567,819 9/1896 Udstad ..... 5/37 C
650,498 5/1900 Welles ..... 5/37 C
4,402,096 9/1983 Atimichuk ..... 5/17

FOREIGN PATENT DOCUMENTS 746075 2/1933 Fed. Rep. of Germany ..... 5/37 C
804026 2/1951 Fed. Rep. of Germany ..... 5/47
851672 8/1952 Fed. Rep. of Germany ..... 5/37 C
866834 12/1952 Fed. Rep. of Germany ..... 5/37 C

*Primary Examiner*—Alexander Grosz
*Attorney, Agent, or Firm*—Lawrence I. Field

[57] ABSTRACT

A piece of furniture which is convertible to a bed, a sofa or couch, a recliner, a sick bed or a day bed for convalescents and which utilizes the geometry of its component parts to facilitate conversion from one mode, e.g., sofa, to another mode, e.g., bed.

7 Claims, 20 Drawing Figures

FIG. 11.
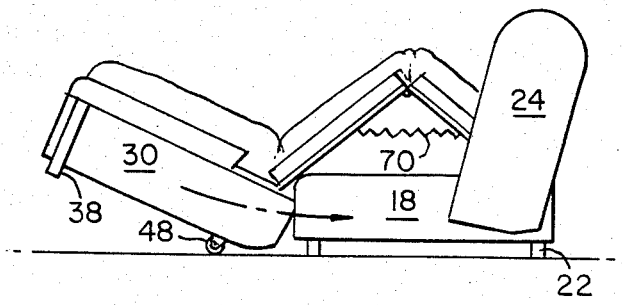
FIG. 12.
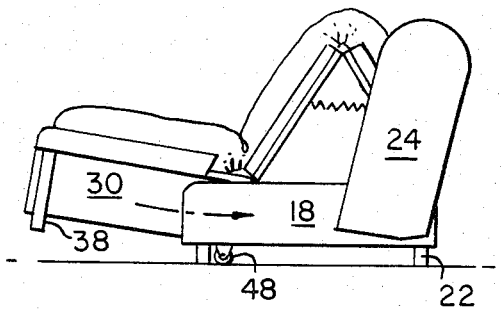
FIG. 13.
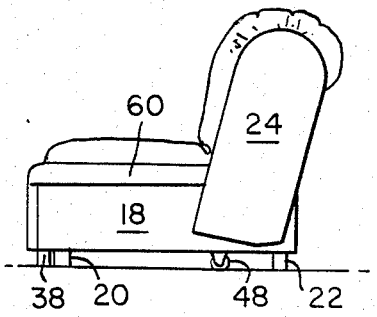
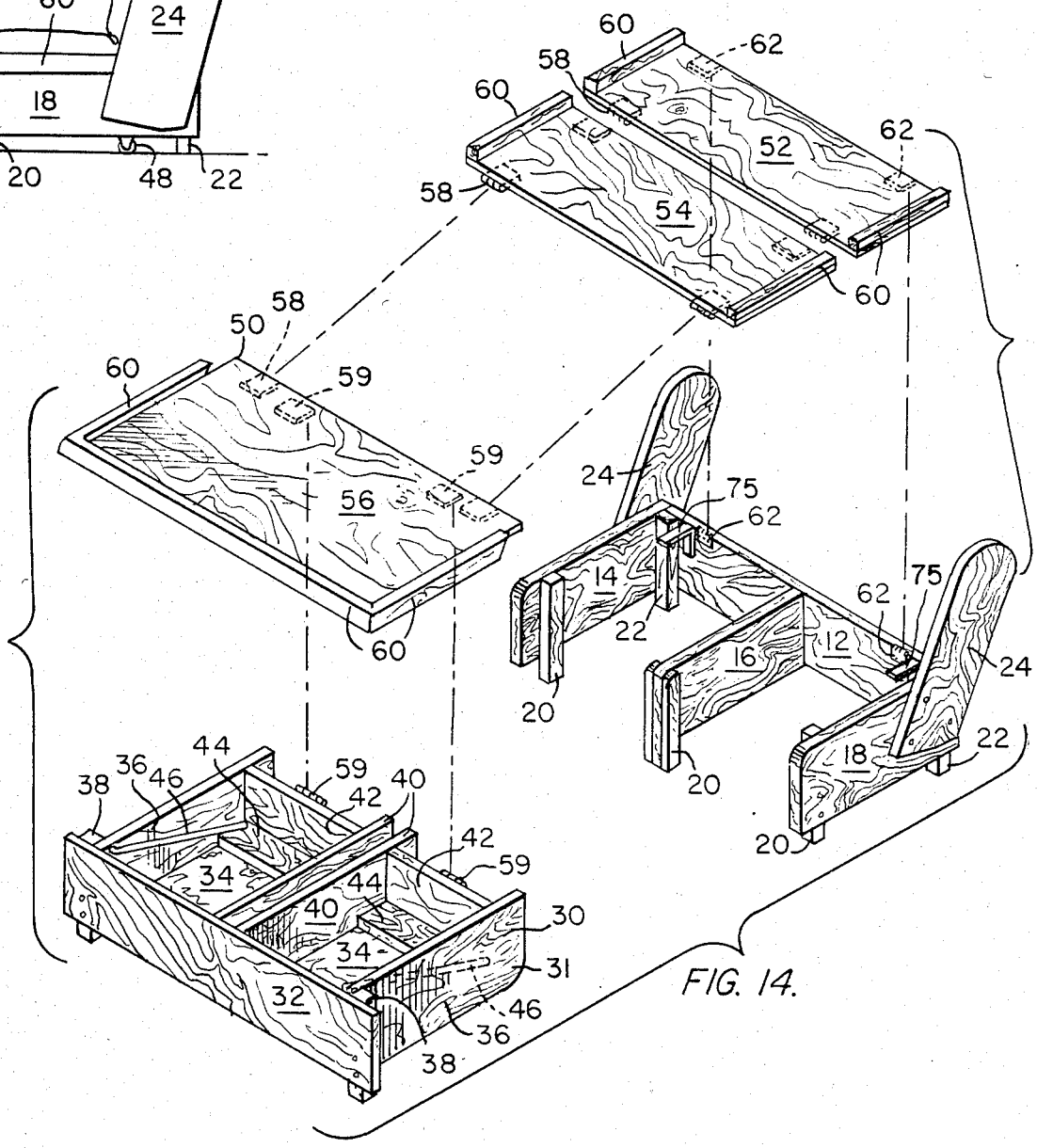
FIG. 14.

CONVERTIBLE FURNITURE

This invention relates to improvements in convertible furniture. More particularly it relates to a piece of furniture which is convertible to a bed, a sofa or couch, a recliner, a sick bed or day bed for convalescents, and which also provides an enclosed storage area.

A principal object of this invention is to provide a convertible sofa/bed which has a unique means to collapse the same and which is dependent on the geometry of the several components of which the sofa/bed is comprised and not on springs, links, levers or counterweights characteristic of prior art convertible furniture.

A further object of the invention is to provide a convertible sofa/bed in which the supporting structure acts as the mechanism for collapsing or converting the furniture from one mode to another mode.

Still an additional object of the invention is to provide a convertible sofa/bed which is virtually effortless and extremely simple to operate.

Still a further object of the invention is to provide a piece of convertible furniture which is stronger than other convertible furniture.

Still another object of the invention is to provide a convertible sofa/bed which consists of relatively few parts and which is simple in design.

Another object of the invention is to provide a convertible sofa/bed which supports a futon.

BRIEF DESCRIPTION OF THE DRAWINGS

These and other objects will be pointed out or will become apparent from the description which follows, taken in conjunction with the accompanying drawings in which:

FIGS. 1 through 13 are schematic views from one side, showing the several stages in converting from a sofa to a bed, and returning the furniture from a bed to a sofa;

FIG. 14 is an exploded view, in perspective showing the several components of which the convertible sofa/bed is constructed;

As shown in FIG. 14, the article of convertible furniture of this invention consists of three sub-assemblies which are identified as a back and rear support subassembly 10, a front support and storage section 30 and a futon or mattress support section 50.

Figure 1:
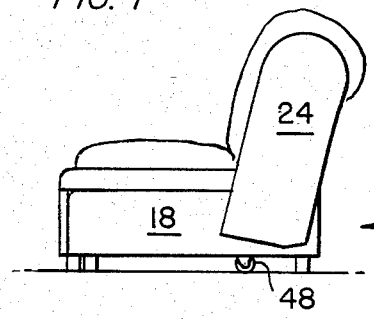

Frame 10 comprises a rear support piece 12 to which three forwardly extending members 14, 16 and 18 are attached by suitable fastening means which are not shown. Legs 20 are attached at the forward end of each of the three forwardly extending members and legs 22 are attached to both the rear support piece 12 and each of the side members 14 and 18 where they meet. Arms 24 are secured to side support members 14 and 18, but it is significant that since no back support for panel 52 is necessary functionally, arms 24 are an optional configuration reserved for and useful for a shelf, headboard or other structure. Trim 60 may also extend entirely around panel 52 as well as panel 56, overlapping with trim 60 on panel 54 esthetically sealing the triangle formed by the two vertical panels forming the back of the sofa in the sofa configuration.

Figure 16:
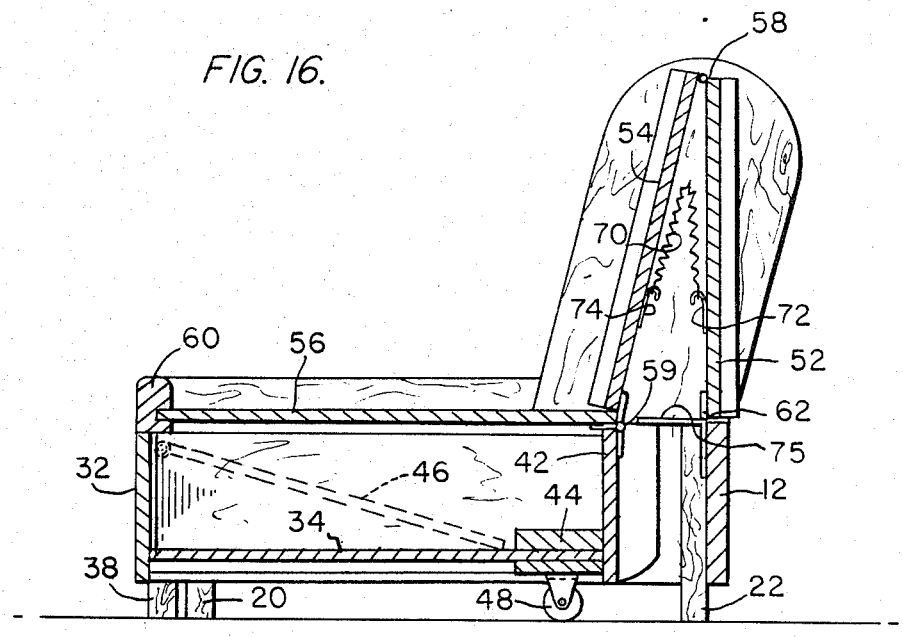
FIG. 16 is a view partly in section taken on plane 16—16 of FIG. 15.
Figure 17:
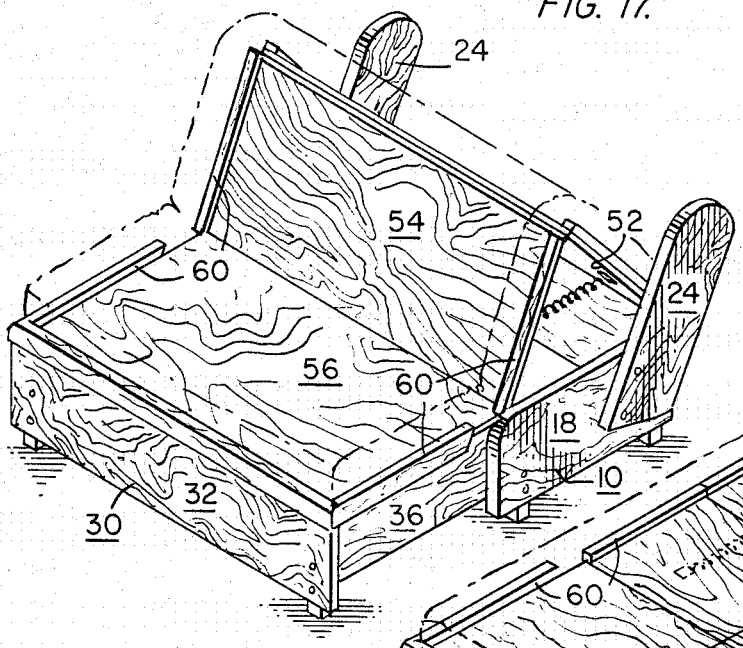
FIG. 17 is a view in perspective showing the sofa in the initial stages of being converted to a bed.
Figure 18:
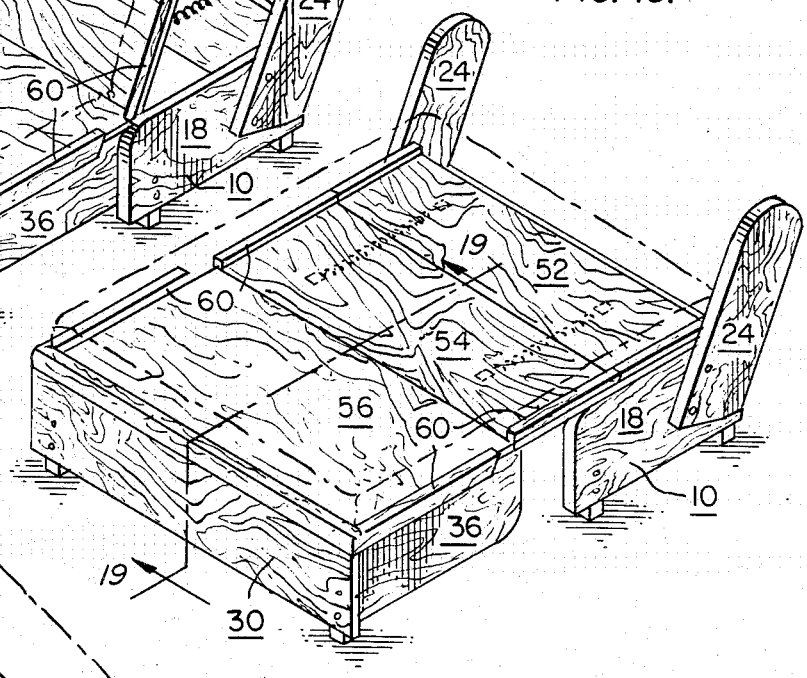
FIG. 18 is a similar view showing the sofa completely converted to a bed.

Front support 30 consists of a front board 32 from which at least one storage chamber extends rearwardly. Each storage chamber is defined by: a bottom 34 which supports the storage chamber, rearwardly extending sides 36 secured adjacent to the ends of front board 32 by corner legs 38 which are fastened to both front board 32 and sides 36 secured adjacent to the ends of front board 32 by corner legs 38 which are fastened to both front board 32 and sides 36, a pair of rearwardly extending sides 40 and two rear boards 42, 44. A cross brace 44 is secured to bottom 34 and to sides 36 and to rear boards 42, to provide a sturdy structure. Two movable braces 46 (FIG. 19) are provided for a purpose which will be described later in this description. Each brace is mounted on the outside or inside of sides 36. Rollers 48 are attached to the bottom 34 (see FIGS. 16 and 19). The rollers may be soft rubber wheels or other conventional wheels.

The third sub-assembly of this article of furniture is the support 50 for a mattress or a futon. The support 50 consists of three panels 52, 54, 56 connected to each other by suitable hinges 58. Panel 56 is provided with a frame at its forward end and along its sides, to provide rigidity to the panel and to assist in keeping the mattress in place. Panel 56 is hingedly connected to movable front supports 30 by hinges 59, and panel 52 is hingedly connected to frame 10 by hinges 62. The lengths of the several panels 52, 54, 56 along the longitudinal axis of the bed are significantly different from one another. Panel 56 must be the longest, panel 54 is shorter than panel 56 and panel 52 is the shortest of the three panels.

Figure 19:
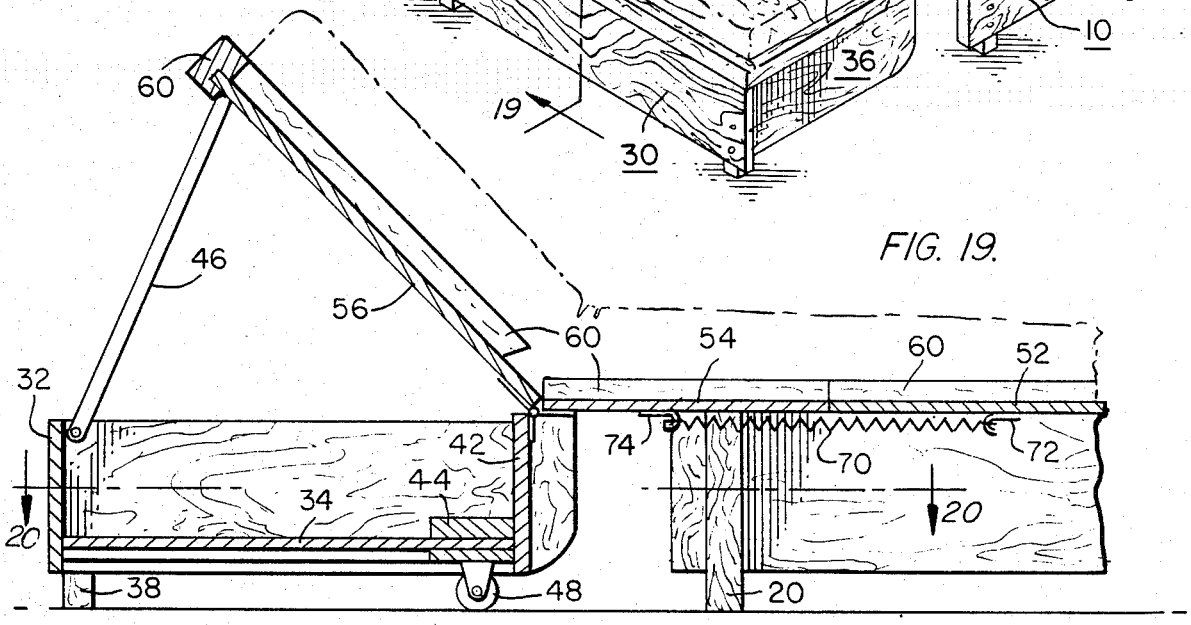
FIG. 19 is a view partly in section taken on plane 19—19 of FIG. 18.
Figure 20:
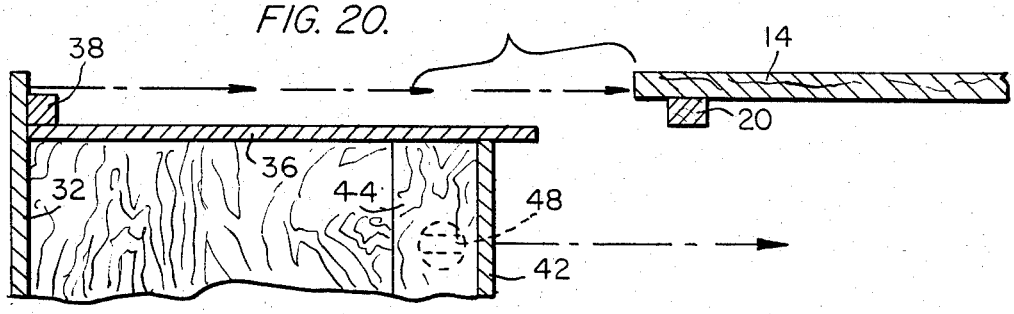
FIG. 20 is a fragmentary view taken on plane 20—20 of FIG. 19.

The preferred ratio of the lengths of the several panels is approximately 1:0.92:0.83 respectively. Although many other combinations can be used within the parametric criteria imposed mainly by the length of the futon, this ratio is particularly satisfactory. The difference in lengths of panels 54 and 52 is significant. The reason for the difference is the following: When in sofa configuration, bed panel 52 will be substantially vertical, and panel 54, being longer, will be inclined. This insures a space of about 7" between the two extreme ends of panels 54 and 52 which provide ample space for springs to fold and hang in. Furthermore, the right triangle formed by inclined panel 54 and vertical panel 52 is so stable that no back support is necessary. When the end of front board 32 is flush against its respective sides 14 and 18, any further motion of panel 52 angularly to the rear results directly in upward motion at the hinge between 56 and 54. A spring 70 is attached to the underside of panel 54 by a fastener 74 and to the underside of panel 52 by a fastener 72 (FIG. 19).

In order to eliminate any give in panel 52, two L-shaped metal pieces (75) were added (FIG. 14, 16). Each piece measures $\frac{3}{4}$ inches wide, 1/16 inches thick, and 6 inches long, and is bent at 90 degrees in the middle so as to have two octagonal arms. each one 3 inches long. These metal pieces are mounted on the inside of support piece 12 so that one of the arms points vertically down and the other points inside, away from piece 12, and is flush with the upper edge of 12. Also, each of the metal pieces is aligned with the rearwardly extending sides 40 in such a way that in the sofa configuration, the 4-inch sections of sides 40 (which extend rearwardly off boards 42) slide tightly under the horizontal arms of the metal pieces. This prevents any lifting of the seat portion of the sofa and any rearward give in the back portion of the sofa in the sofa configuration.

The sequence of operations whereby the sofa is converted to a bed or backrest or footrest will now be described with reference to the series of schematic silhouettes shown as FIGS. 1–13.

Figure 2:
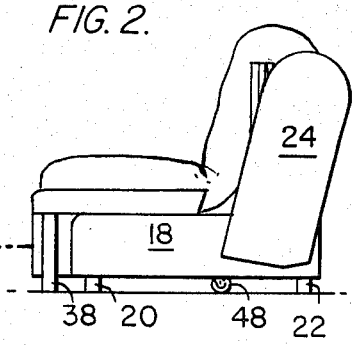
Figure 3:
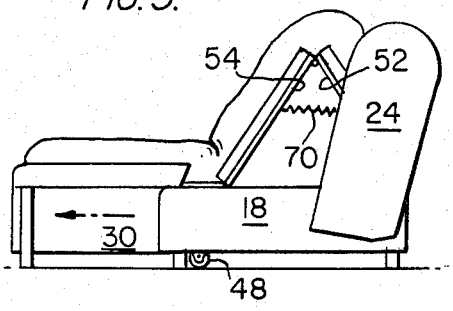
Figure 4:
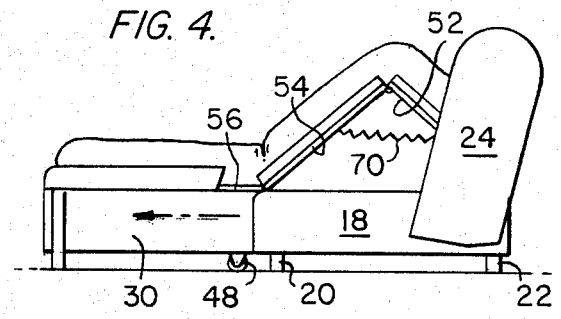

First the user grasps the movable bottom section 30 and pulls it away from the frame 10 as shown in FIGS. 1 and 2. As the movable section moves away from the frame, panel 52 which is hingedly connected to the frame 30 begins to unfold from the middle panel 54 to which it is connected by hinge 58. The unfolding may be only partial as shown in FIG. 3 so that the mattress, supported by panels in an elevated position may be used as a back support while the user's feet may extend beyond the end of the mattress which covers the movable bottom section.

Figure 5:
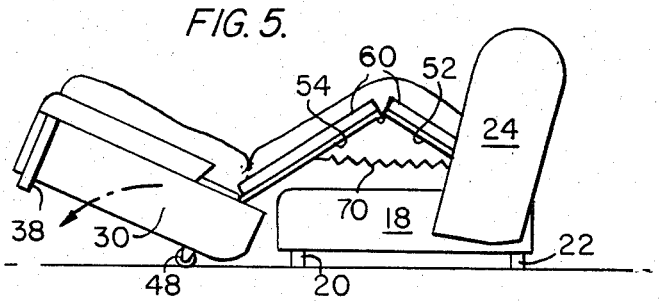
Figure 6:
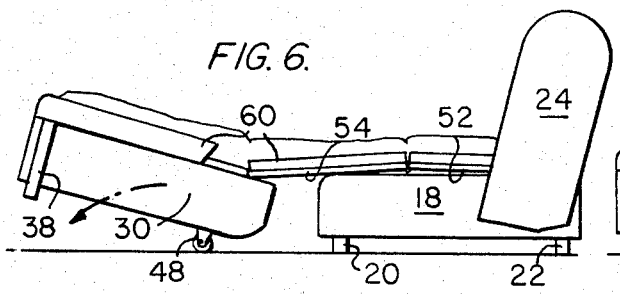
Figure 7:
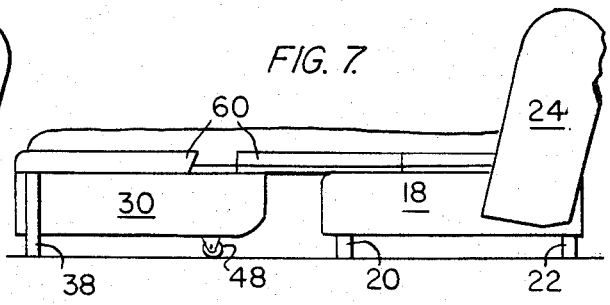

If it is desired to fully extend the sofa to form a bed, the user lifts the front end of the movable section 30 and rolls it away from frame 10 as shown in FIGS. 5 and 6. The hinge between panels 52 and 54 opens permitting the two panels to lie in a horizontal plane, and then the hinge between panels 54 and 56 permits them to lie in a horizontal plane once the user puts the front end down on the floor. In this position, the sofa has been converted to a bed, as shown in FIG. 7, with panel 54 bridging the space between frame 10 and movable support 30.–

Figure 8:
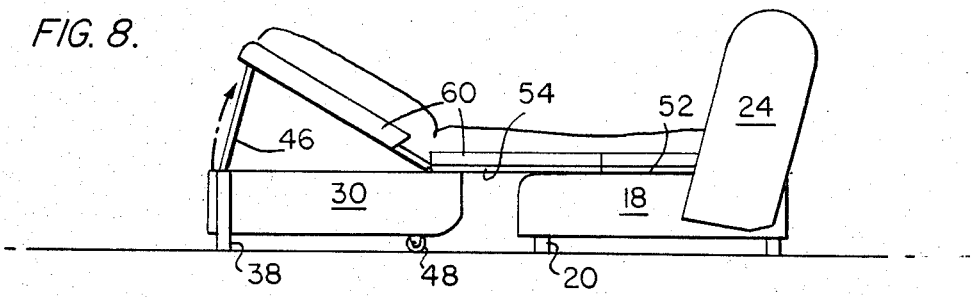

By elevating panel 56 and inserting brace 46 between the panel 56 and the front 32 of the movable section 30 the bed is converted to a foot rest or lounger as shown in FIG. 8, and if the user chooses to reverse his position the raised panel—may serve as a backrest.

Figure 9:
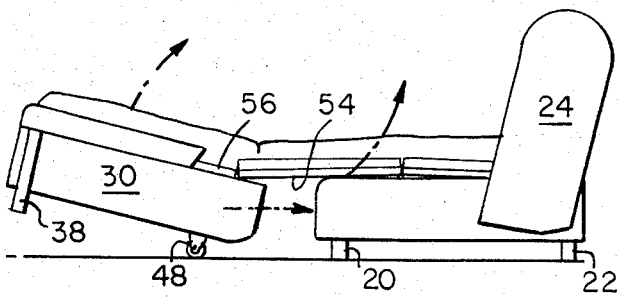
Figure 10:
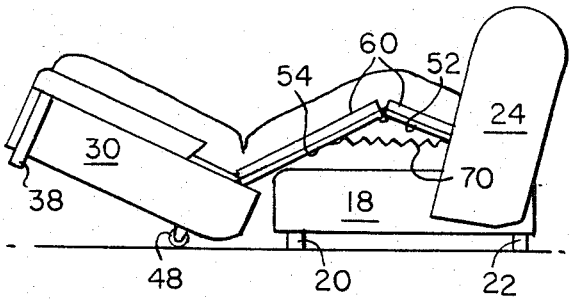
Figure 15:
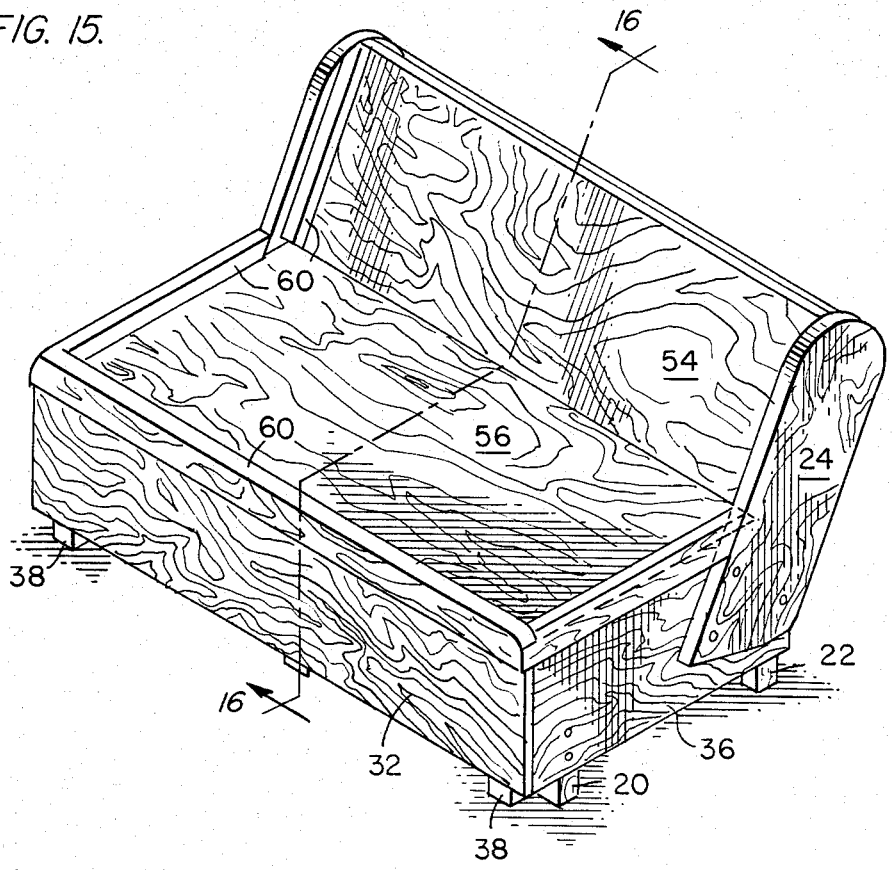
FIG. 15 is a view in perspective showing the sofa bed as a sofa.

Reversing the sequence converts the bed back to a sofa. First panel 56 is lifted and brace 46 is restowed in a flat horizontal position under the panel. Then panel 56 and the front end of movable section 30 is lifted at its outer end and wheeled toward the frame 10 (FIG. 9). This causes the hinges connecting the three sections of cover 50 to begin to close until finally the movable section is stowed in frame 10 and the furniture is again a sofa as shown in the sequences of FIGS. 11–13.

It is important to note that instead of having 2 systems, as is usual, one to support the bed/couch and the other to act as a mechanism to initiate the folding, continue it and lock it in place, this sofa-bed has one integral system to perform all these functions. The economy and elegance of the system depends primarily on the following fact: The top section 50 is comprised of three hingedly connected sections (one double hinged and two singly hinged) which are supported by frame 10 and movable section 30. Each of the three hinged sections is shorter than the supporting sections and there is precisely the correct overlap to effect:

(1) properly spaced support, (2) breaking and folding action, (3) and accurate fit when interlocking to assume sofa configuration.

The movable (or couch seat) section is supported by two legs at one end and by wheels at the other. The wheels however must be carefully positioned to act as a fulcrum pivot when the seating section is manually raised. As this section is raised, the wheels first of all move rearward and cause the seat hinge to be lowered, this breaks the second hinge joint on the pivot of the support itself. Then, as the seat is lowered again, the curvature on the support corner 31 allows the back rest section to ride up along the support until the bed is folded to the point of a recliner or couch.

One of the particular advantages of the convertible sofa/bed described above is that it is able to accomodate a "futon", a heavy mattress stuffed with cotton which was developed in Japan and is becoming increasingly popular in the Western Hemisphere. Because of their weight futons have placed unique, unprecedented and hitherto unsolved demands on conventional folding bed systems.

A spring 70 chosen in accordance with the weight of the futon mattress to be used (single, double, queen, or king) is secured to panels 52 and 54. When the spring is properly selected, it balances the weight of the futon mattress and as a result the operation of the bed is virtually effortless.

Trim 60 is provided around three sides of panel 56 and a smaller trim 60' may be provided along the edges of panels 52 and 54.

A solid back or a slatted construction may be provided, if desired, connecting arms 24 to each other, and longer hinges may be used than those shown in the figures, and the number of wheels may be increased, and other minor changes may be made in the construction shown in the embodiment described above without departing from the spirit of the present invention.

Having now described a preferred embodiment of the invention it is not intended that it be limited except as may be required by the appended claims.

I claim:

1. An article of furniture which is usable in any of the following modes: as a bed or couch; as a chair or sofa; a recliner; a sick bed or day bed for convalescents and which also provides an enclosed storage area which comprises three hingedly interconnected subassemblies as follows a first subassembly consisting of a rear support beam from which two side support members extend forward each of said side members being connected to said rear support by fasteners, legs secured to the side members and to the rear support at their intersection, a center support member fastened to the center of said rear support and extending forwardly of said rear support member, legs secured adjacent to the forward end of each of said side members and said center member, and a pair of hinges adjacent the top of said rear support member;

a second subassembly comprising a storage and front portion including a front support member, four rearwardly extending support members, fastened to said front support member the first two of said rearwardly extending members being sideboards and being further secured to said front support member by legs located at the intersection of said front support member and said rearwardly extending members at their intersection; the other two of said rearwardly extending support members being spaced apart so as to straddle the center support member of the support beam; and a floor fastened to the four sides defined by said front support, one of said first two rearwardly extending sideboards and one of said other rearwardly extending members and said cross brace;

and a third subassembly hingedly connected to each of said first and said second subassemblies, and consisting of three panels, namely a first panel which is shorter than the forwardly extending side support members of said first assembly and which is hingedly connected along its rear edge to said rear support beam a second panel hingedly connected at its rear edge to the front edge of said first panel and hingedly connected at its front edge to the rear edge of a third panel; said third panel being hingedly connected to the front support member of said second subassembly, said third panel being shorter than the rearwardly extending support members of said second subassembly.

2. The article of furniture of claim 1 including in addition at least one spring attached to the lower side of said first and said second panels to assist in bringing said two panels together when said article of furniture is converted from a bed mode to a chair or sofa mode.

3. The article of furniture of claim 1 including a brace securable between the first assembly and the rear of said third panel.

4. The article of furniture of claim 1 including rollers mounted on the underside of said floor to facilitate movement of said second subassembly into resting engagement with said front subassembly.

5. The article of furniture of claim 1 supporting a futon.

6. The article of furniture of claim 1 where the panels in the third subassembly are of unequal lengths, the first panel being the shortest and the third panel being the longest.

7. The article of furniture of claim 1 in which the first subassembly includes a pair of arms connected to each other by said rear support beams.

* * * * *